US010370182B2

(12) United States Patent
Accursi

(10) Patent No.: US 10,370,182 B2
(45) Date of Patent: Aug. 6, 2019

(54) CONTAINMENT BODY FOR MAKING A CAPSULE FOR MAKING BEVERAGES AND METHOD FOR MAKING CAPSULES WITH DIFFERENT QUANTITIES OF POWDERED FOOD SUBSTANCE USING A SINGLE TYPE OF CONTAINMENT BODY

(71) Applicant: CAFFITALY SYSTEM S.P.A., Gaggio Montano (Bologna) (IT)

(72) Inventor: Giovanni Accursi, Porretta Terme (IT)

(73) Assignee: CAFFITALY SYSTEM S.P.A., Gaggio Montano (IT)

( * ) Notice: Subject to any disclaimer, the term of this patent is extended or adjusted under 35 U.S.C. 154(b) by 158 days.

(21) Appl. No.: 15/526,536

(22) PCT Filed: Nov. 20, 2015

(86) PCT No.: PCT/IB2015/059015
§ 371 (c)(1),
(2) Date: May 12, 2017

(87) PCT Pub. No.: WO2016/087981
PCT Pub. Date: Jun. 9, 2016

(65) Prior Publication Data

US 2017/0320658 A1 Nov. 9, 2017

(30) Foreign Application Priority Data

Dec. 3, 2014 (IT) ..... VR2014A0302

(51) Int. Cl.
*B65D 85/804* (2006.01)

(52) U.S. Cl.
CPC ..... *B65D 85/8043* (2013.01)

(58) Field of Classification Search
CPC .. B65D 85/8043; A47J 31/407; A47J 31/0642
See application file for complete search history.

(56) References Cited

U.S. PATENT DOCUMENTS 6,849,285 B2 * 2/2005 Masek ..... B65D 85/8043 426/112
7,543,527 B2 6/2009 Schmed
(Continued)

FOREIGN PATENT DOCUMENTS

EP 1344722 A1 9/2003
WO 2011117768 A1 9/2011
(Continued)

*Primary Examiner* — Eric Keasel
(74) *Attorney, Agent, or Firm* — Pearne & Gordon LLP

(57) ABSTRACT

A containment body for making a cup-shaped capsule for making beverages comprising a lateral wall (4) that, in a zone of it closer to an upper edge (5) than to a bottom wall (3), is provided with one or more retaining elements (8) projecting towards the central axis in a plane substantially perpendicular to the central axis, the one or more retaining elements (8) forming between them and the bottom wall (3) an undercut seat (9); and a method for making capsules comprising different quantities of powdered food substance using said containment body (1) and positioning an upper filtering element (16) either coupled to the undercut seat (9) or positioned close to a lid (15).

34 Claims, 10 Drawing Sheets

(56) References Cited

U.S. PATENT DOCUMENTS

| | | | | |
|---|---|---|---|---|
| 8,505,440 | B2 * | 8/2013 | Kirschner | A23F 3/06 426/77 |
| 9,486,105 | B2 | 11/2016 | Perentes et al. | |
| 2003/0172813 | A1 | 9/2003 | Schifferle | |
| 2007/0148290 | A1 | 6/2007 | Ternite et al. | |
| 2011/0142996 | A1 * | 6/2011 | Kruger | B65B 29/022 426/80 |
| 2014/0305314 | A1 | 10/2014 | Perentes et al. | |
| 2014/0314919 | A1 | 10/2014 | Perentes et al. | |
| 2015/0196159 | A1 | 7/2015 | Spiegel et al. | |

FOREIGN PATENT DOCUMENTS

| | | | |
|---|---|---|---|
| WO | 2013060656 | A1 | 5/2013 |
| WO | 2013068242 | A1 | 5/2013 |
| WO | 2013136210 | A1 | 9/2013 |
| WO | 2014029884 | A1 | 2/2014 |
| WO | 2014/118731 | A1 | 8/2014 |
| WO | 2014118743 | A1 | 8/2014 |

* cited by examiner

CONTAINMENT BODY FOR MAKING A CAPSULE FOR MAKING BEVERAGES AND METHOD FOR MAKING CAPSULES WITH DIFFERENT QUANTITIES OF POWDERED FOOD SUBSTANCE USING A SINGLE TYPE OF CONTAINMENT BODY

This invention relates to a containment body for making a capsule for making beverages that can contain different quantities of powdered food substance, and a method for making capsules with different quantities of powdered food substance using a single type of containment body.

The sector for making beverages using capsules containing a powdered food substance through which hot water is passed after the capsule has been inserted in an extraction chamber of a suitable machine, in recent years has seen considerable evolution which has led to the development of capsules for making many different types of beverages.

Amongst the prior art capsules there are two large families, that in which the powdered food substance is soluble and so comes out completely with the extraction water, and that in which the powdered food substance is not soluble (at least not completely) and making the beverage involves using hot water to extract the flavours from the powdered food substance.

The latter type includes capsules for making espresso coffee or American coffee (obviously not the soluble type).

Aside from the fact that every manufacturer has developed its own type of capsules and corresponding machines, over the years it has also become necessary for the same manufacturer to make capsules that differ according to the type of beverage to be made. In particular, there has been a gradual increase in the need to make capsules of different volume for containing different quantities of powdered food substance. In fact, making different beverages may require different quantities of powdered food substance. For example, while a good espresso coffee can be made using around 8 g of coffee powder, a good American coffee needs around 11 g of coffee powder. More generally, whilst optimal preparation of limited quantities of beverages ("short" beverages such as espresso coffee) may require the use of a relatively small amount of powdered food substance, optimal preparation of larger quantities of beverage ("long" beverages like American coffee, hot chocolate, tea, etc.) normally requires the use of larger quantities of powdered food substance.

Over the years, this problem has brought to the market parallel systems for making beverages, some with relatively small capsules to be used in suitable machines, and others with relatively large capsules for use with different machines dedicated to them.

As regards the structure of the capsules, those of interest for this invention generally comprise a cup-shaped containment body (made with one or more parts), closed at the top by a lid. Inside the containment body, in addition to the powdered food substance, there may be filtering elements that can be positioned either between the powdered food substance and the bottom wall of the containment body, or between the powdered food substance and the lid. Depending on the direction in which the water flows inside the capsule, which in this context is usually from the lid towards the bottom wall or vice versa, the filtering element may act either as a water distributor in the powdered food substance, or as a filter for the beverage coming out to prevent the powdered food substance from accidentally coming out.

However, the current market situation has several obvious disadvantages.

In particular, any company that wants to be present on the market both with capsules for making "short" beverages and with capsules for making "long" beverages must have two product lines both for the capsules and for the machines.

Similarly, the end user is forced to purchase a machine for each type.

In this context, the technical purpose that forms the basis of this invention is to make a containment body for making a capsule for making beverages and to provide a method for making capsules with different quantities of powdered food substance using a single type of containment body, that overcome the above-mentioned disadvantages.

The technical purpose and the aims indicated are substantially achieved by a containment body for making a capsule for making beverages and a method for making capsules with different quantities of powdered food substance using a single type of containment body, as described in the appended claims.

Further features and the advantages of this invention are more apparent from the detailed description of several preferred, non-limiting embodiments of a containment body for making a capsule for making beverages and of a method for making capsules with different quantities of powdered food substance using a single type of containment body, illustrated with reference to the accompanying drawings, in which.

Figure 5:
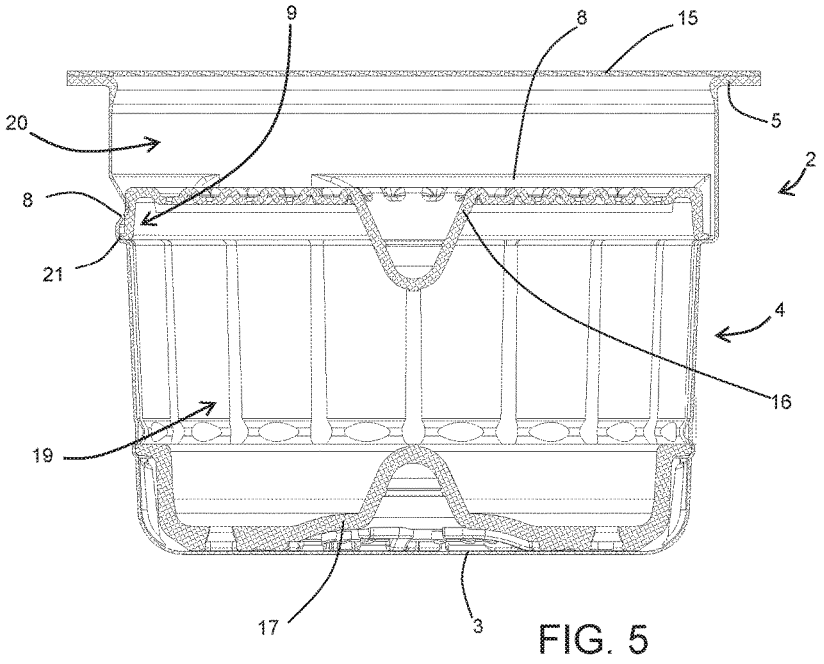
FIG. 5 shows the capsule of FIG. 4 assembled.
Figure 6:
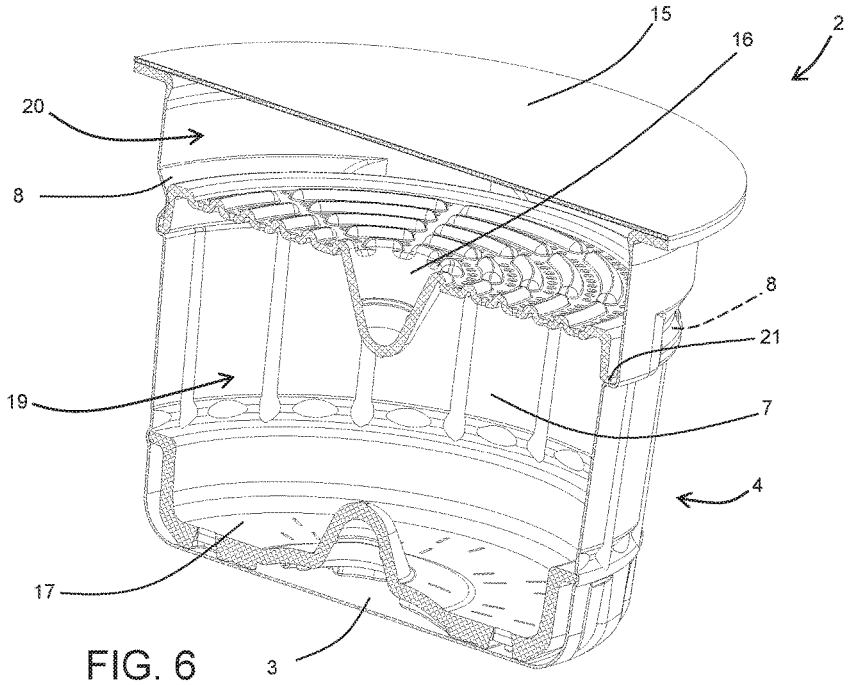
FIG. 6 shows the capsule of FIG. 3 assembled.
Figure 11:
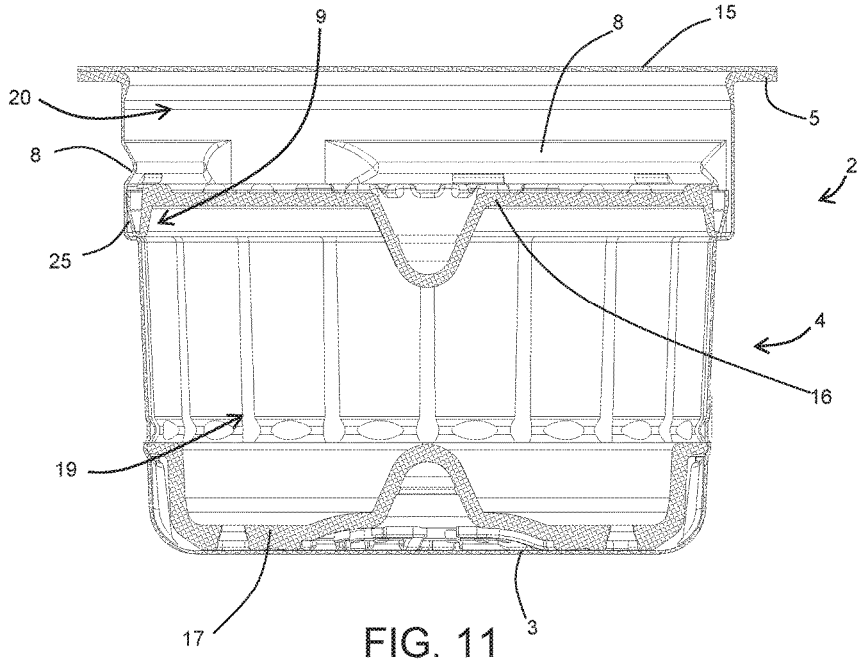
FIG. 11 shows the capsule of FIG. 10 assembled.
Figure 12:
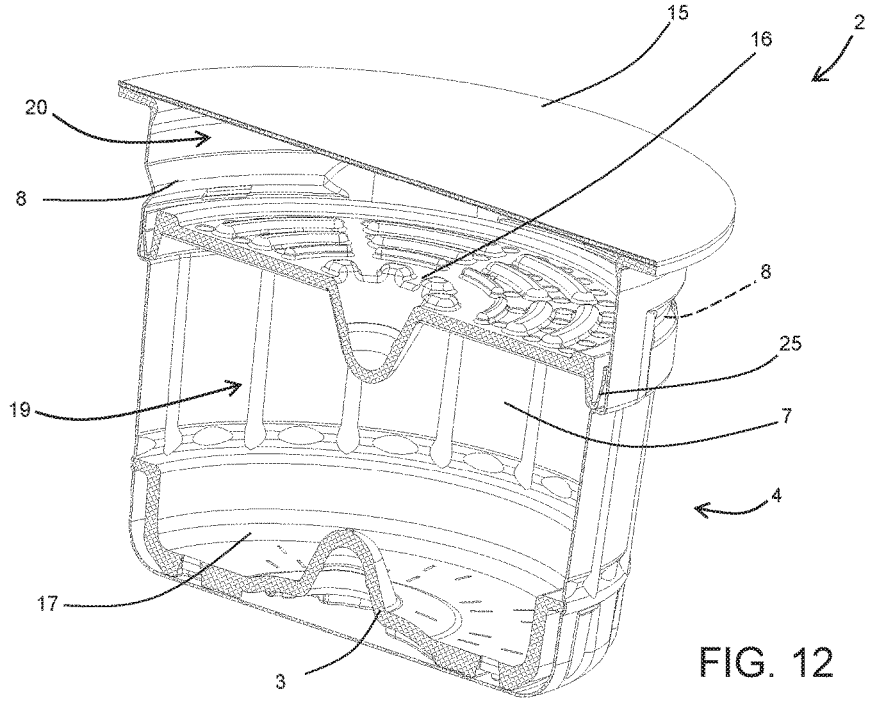
FIG. 12 shows the capsule of FIG. 9 assembled.
Figure 13:
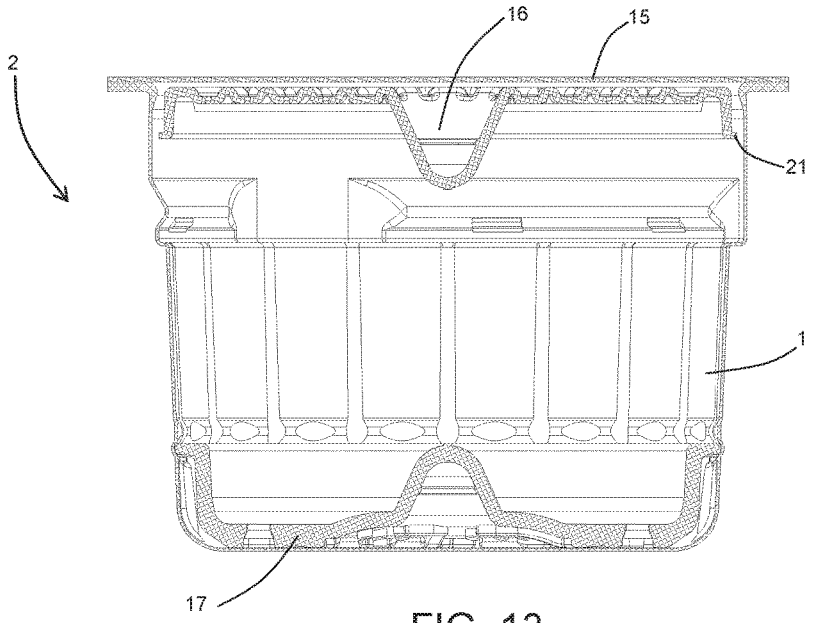
Figure 14:
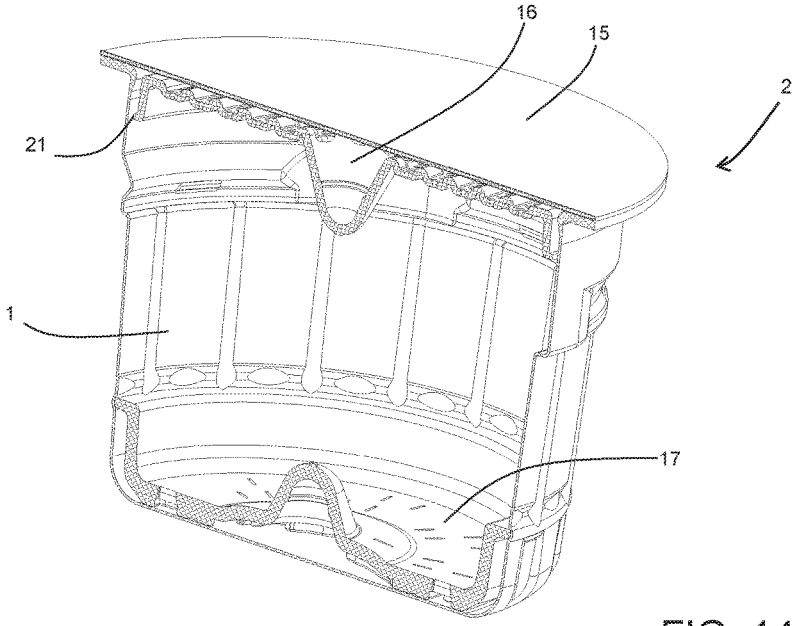
Figure 15:
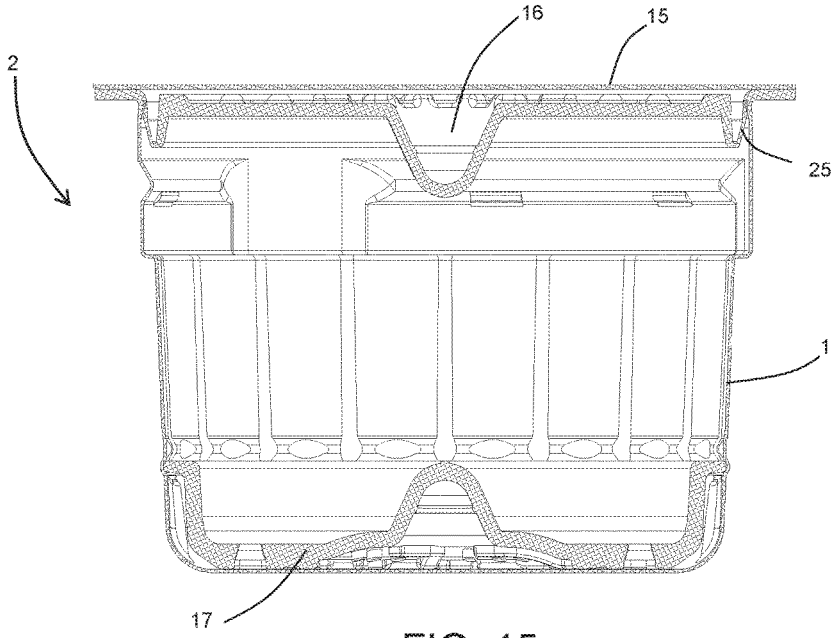
Figure 16:
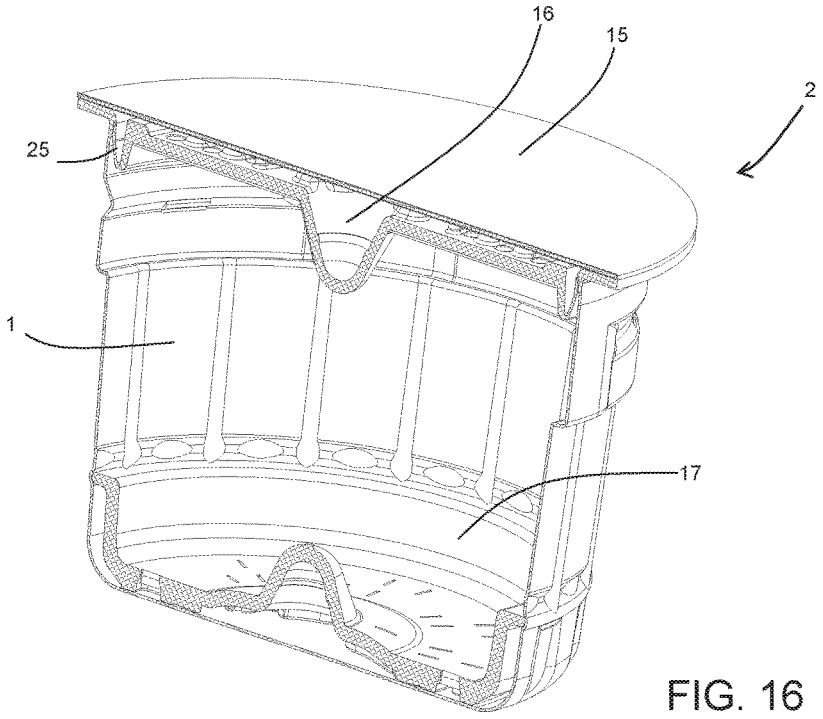

FIGS. 13 and 14 show the same variant of the capsule respectively of FIGS. 5 and 6; and FIGS. 15 and 16 show the same variant of the capsule respectively of FIGS. 11 and 12.

With reference to the above-mentioned figures, the numeral 1 denotes in its entirety a containment body for capsules 2 for making beverages that is made according to this invention.

In fact, at the heart of this invention is the fact that it has provided a containment body 1 able to contain equally well at least two different quantities of powdered food substance, in any case always guaranteeing correct containment of the powder.

Therefore, there follows a description first of the containment body 1 and several different capsule 2 that can be made with it, and then of the method for making them. In any case, it shall be understood that what is described relative to one of them is also valid for the others if compatible.

In general, the containment body 1 comprises a bottom wall 3, a lateral wall 4 connected to the bottom wall 3 at a peripheral portion of the bottom wall 3 and an upper edge 5 connected to the lateral wall 4 on a side opposite to the bottom wall 3. Advantageously, the bottom wall 3 and the lateral wall 4 give the containment body 1 the shape of a cup or a glass.

Depending on requirements, the bottom wall 3, the lateral wall 4 and the upper edge 5, as a whole or individually, may be made of a single piece of material or multiple different pieces of material (for example, to make zones that are less resistant to breaking). However, in the preferred embodiment, at least the lateral wall 4 and the upper edge 5, but advantageously also the bottom wall 3, are at least mainly constituted of a thermoformed thermoplastic material, even more preferably with a multi-layer thermoplastic material comprising at least one layer constituting a barrier to oxygen (such as EVOH).

The upper edge 5 delimits an access opening 6 through which access is possible to an inner space 7 of the containment body 1. The inner space 7 is delimited at the top by the access opening 6, at the bottom by the bottom wall 3 and laterally by the lateral wall 4. In use, a powdered food substance for making a beverage and one or more filtering elements can be inserted in the inner space, as described in more detail below.

In the containment body 1 a central axis can be identified, extending between a central point of the bottom wall 3 and a central point of the access opening 6. It should be noticed that in the context of this description the terms lower and upper are used considering the containment body 1 oriented with the bottom wall 3 at the bottom and the access opening 6 at the top. In any case, it shall be understood that said usage has nothing to do with the orientation of the capsule 2 during use.

According to a first innovative aspect of this invention, the lateral wall 4 is provided with one or more retaining elements 8 that project towards the central axis and lie in a plane substantially perpendicular to the central axis. It should be noticed that, in this context, the definition that the one or more retaining elements 8 lie in a plane substantially perpendicular to the central axis shall be understood in the sense that they all lie in the same annular portion of the lateral wall 4, extending about the central axis substantially on the lateral surface of a virtual disk-shaped element whose main faces are substantially perpendicular to the central axis.

The one or more retaining elements 8 cause a narrowing of the inner space 7 (perpendicularly to the central axis) relative to the portions of lateral wall 4 immediately adjacent to them (along the line parallel to the central axis). Moreover, they define, between them and the bottom wall 3 an undercut seat 9 relative to the line of extension of the central axis. As is described in more detail below, said undercut seat 9, in use, may be used to limit the possibility of movement towards the access opening 6, of an upper filtering element inserted in the capsule 2.

Moreover, according to this invention, the one or more retaining elements 8 are made at a zone of the lateral wall 4 closer to the upper edge 5 than to the bottom wall 3.

Although it is possible for the lateral wall 4 to comprise a single retaining element 8 (that may extend along an entire ring centred on the central axis or along most of such a ring), in the preferred embodiments, the lateral wall 4 is provided with a plurality of retaining elements 8 distributed, preferably evenly, about the central axis in the above-mentioned plane substantially perpendicular to the central axis. Said retaining elements 8 are spaced out and between two successive retaining elements 8 there are portions of the lateral wall 4 that are substantially not deformed.

In the preferred embodiments, the retaining elements 8 are also made by thermoforming simultaneously with production of the containment body 1.

In the embodiments illustrated in the accompanying figures, the lateral wall 4 comprises, going from the bottom wall 3 towards the upper edge 5, a first portion 10 and a second portion 11 with different shapes.

In fact, the first portion 10 is at least mainly frustoconical with the larger base facing towards the second portion 11, whilst the second portion 11 is substantially cylindrical. Moreover, the second portion 11 has a larger internal diameter than the maximum internal diameter of the first portion 10. Consequently, in the connecting zone between the first portion 10 and the second portion 11 the lateral wall 4 defines, at the inner space 7, a radial shoulder 12 that in use limits the possibility of movement of the upper filtering element towards the bottom wall 3.

Figure 7:
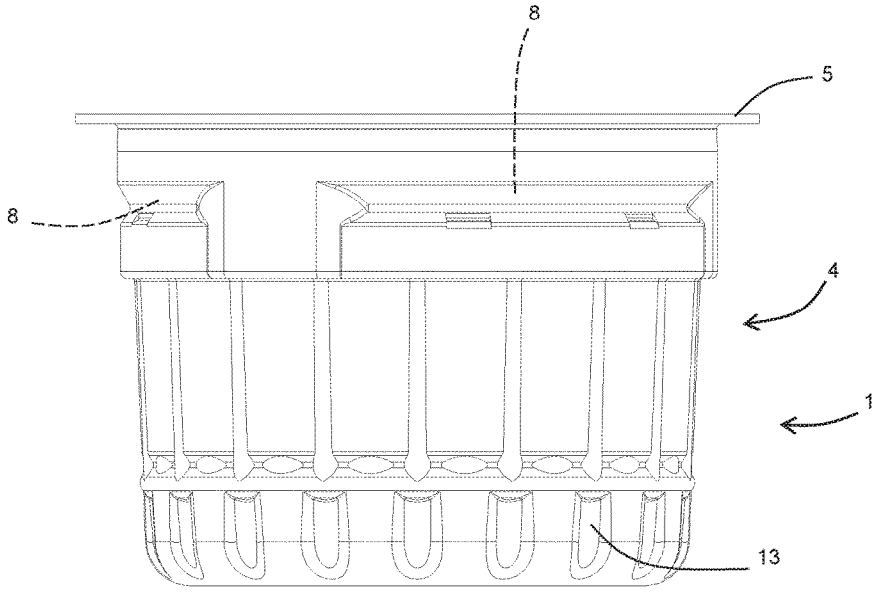
FIG. 7 is a side view of a second embodiment of a containment body made according to this invention.
Figure 8:
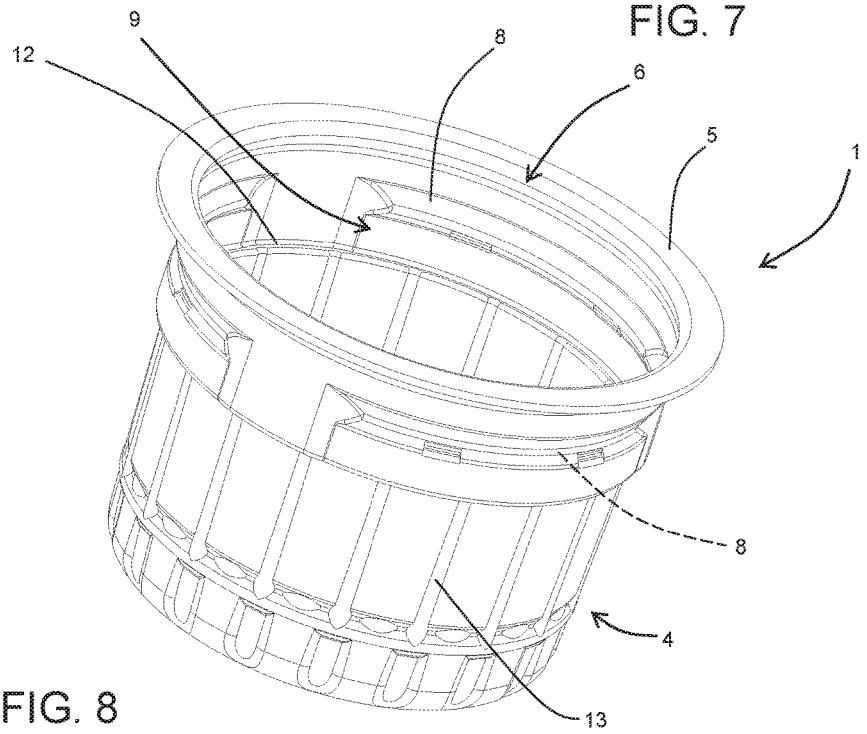
FIG. 8 is an axonometric view of the containment body of FIG. 7.
Figure 9:
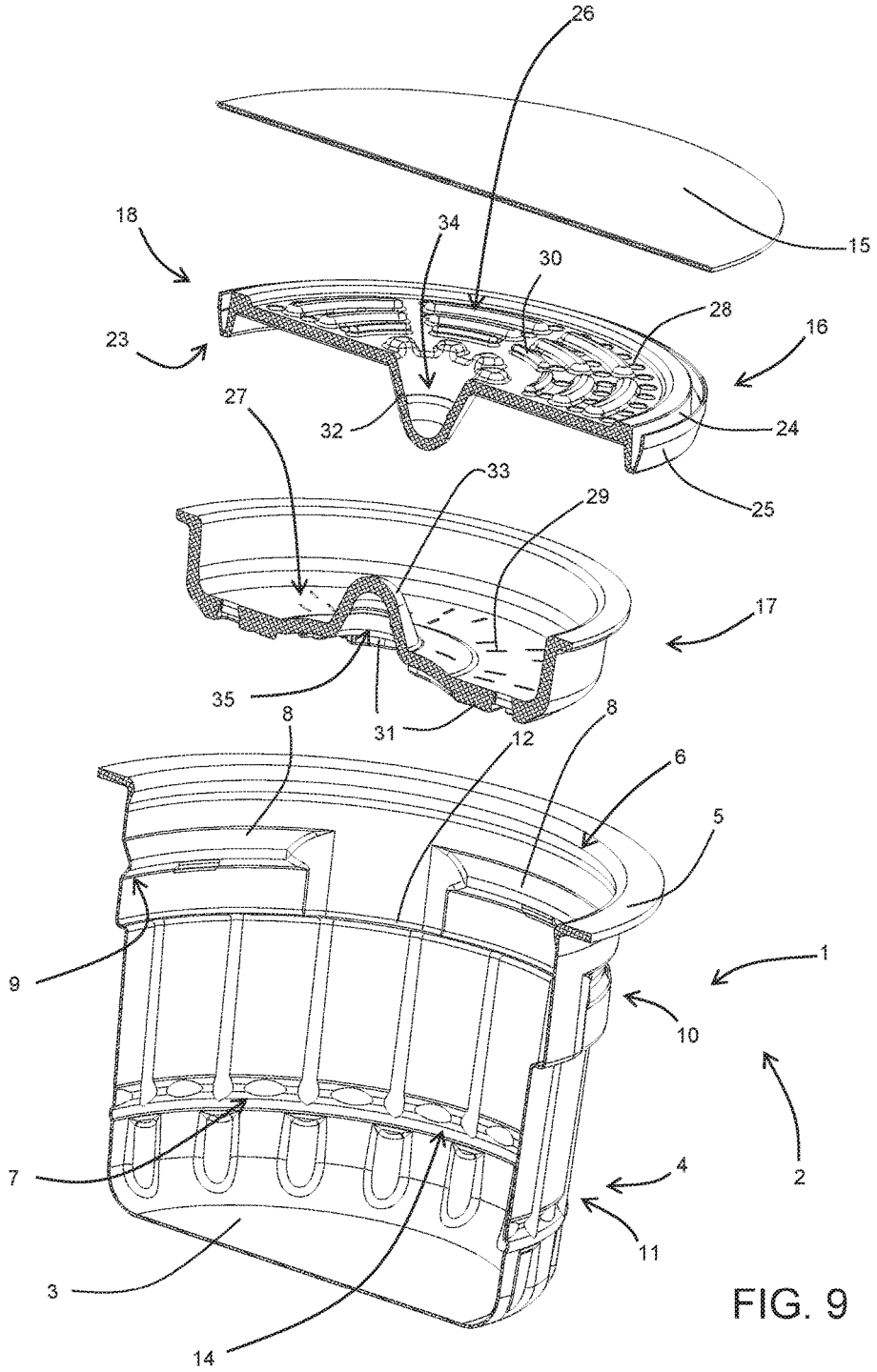
FIG. 9 is an axonometric axial cross-section view of a second capsule (for clarity, without the powdered food substance) comprising the containment body of FIG. 7.
Figure 10:
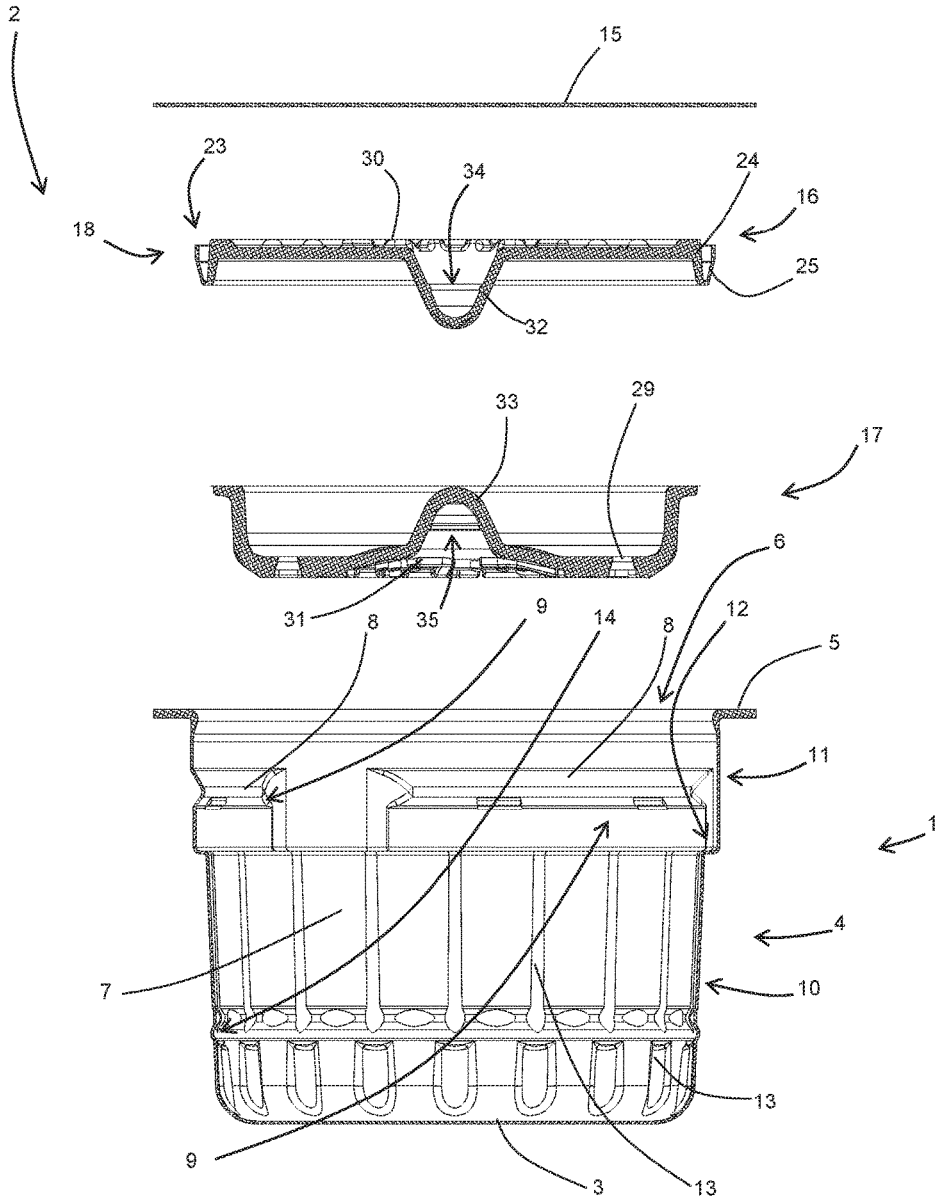
FIG. 10 is a front view of the capsule of FIG. 9.

Advantageously, the one or more retaining elements 8 and the undercut seat 9 are all made at the second portion 11. As can be seen by comparing FIGS. 1 and 7, the position of the one or more retaining elements 8 and of the undercut seat 9 along a line parallel to the central axis may differ depending on the type of filtering element that is to be inserted at the undercut seat 9.

In the preferred embodiments in which the lateral wall 4 is constituted of a multi-layer material with one or more layers made of thermoplastic material, the first portion 10 comprises a plurality of stiffening profiles 13.

Furthermore, in the embodiments illustrated in the accompanying figures, at a zone of it closer to the bottom wall 3 than to the access opening 6, the lateral wall 4 also comprises a hooking seat 14 designed in use to allow the correct fixed positioning of a lower filtering element inserted in the capsule 2. In the known way, said hooking seat 14 is formed by a portion of the lateral wall 4 that projects towards the central axis and/or away from the central axis.

Figure 1:
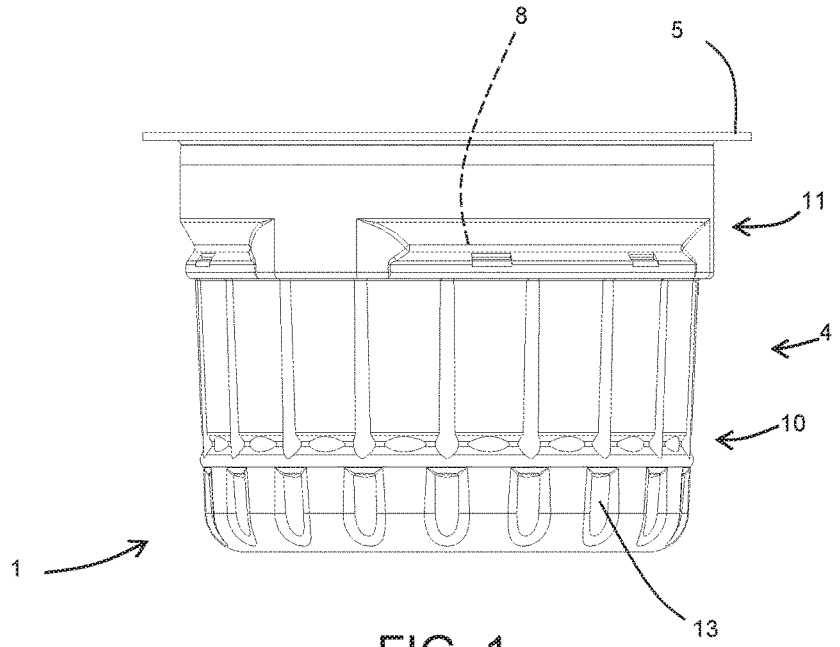
FIG. 1 is as side view of a first embodiment of a containment body made according to this invention.
Figure 2:
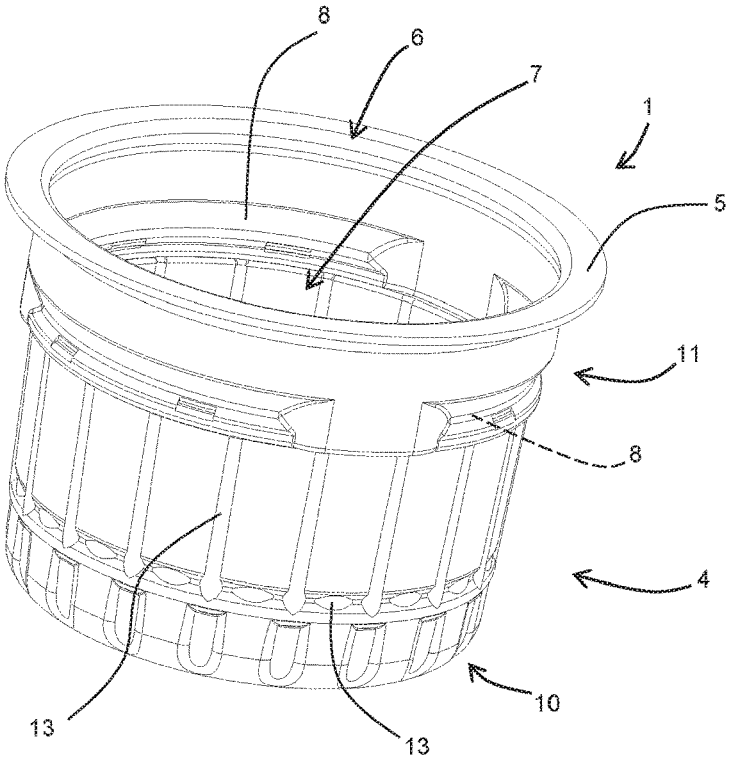
FIG. 2 is an axonometric view of the containment body of FIG. 1.
Figure 3:
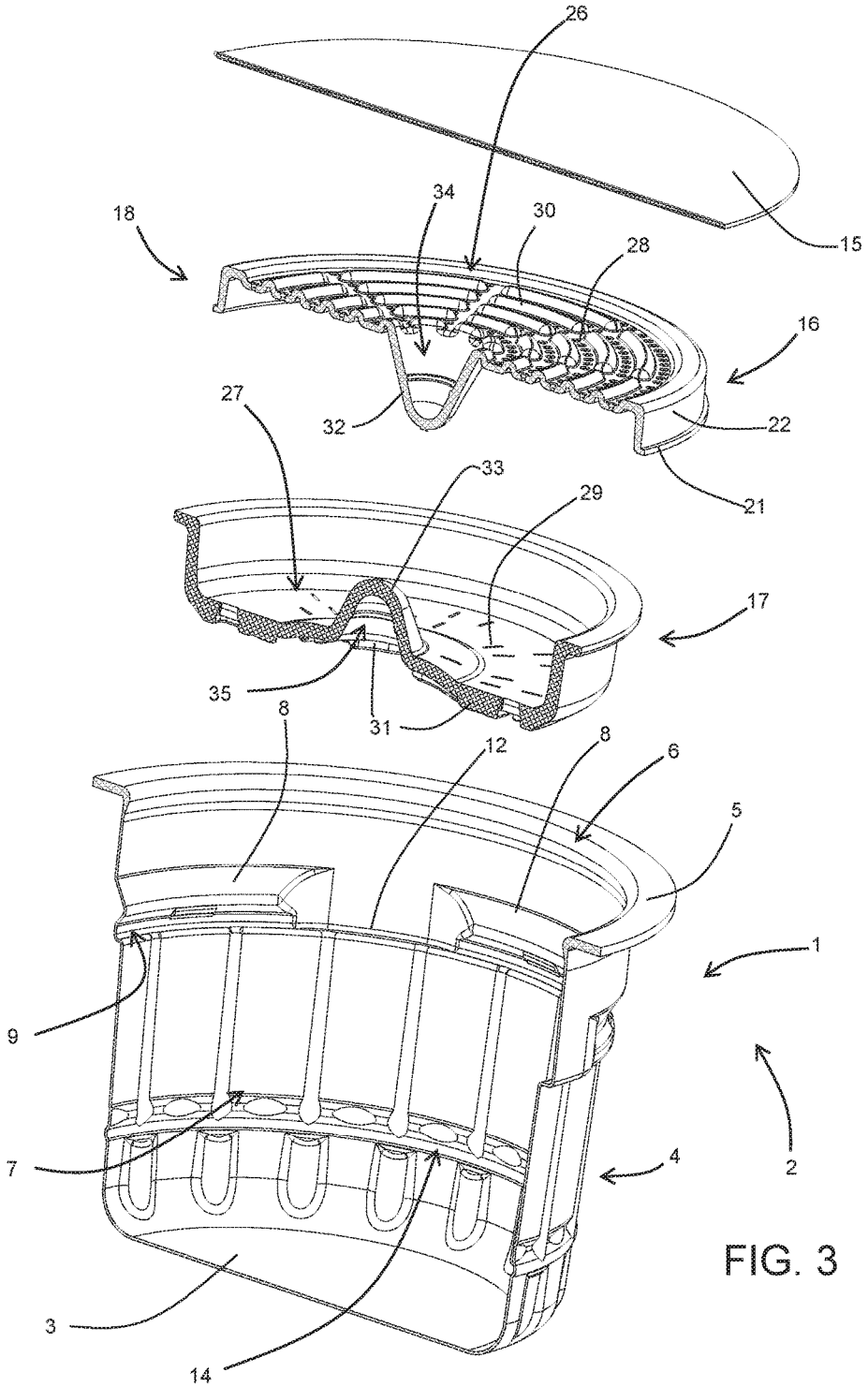
FIG. 3 is an axonometric axial cross-section view of a first capsule (for clarity, without the powdered food substance) comprising the containment body of FIG. 1.
Figure 4:
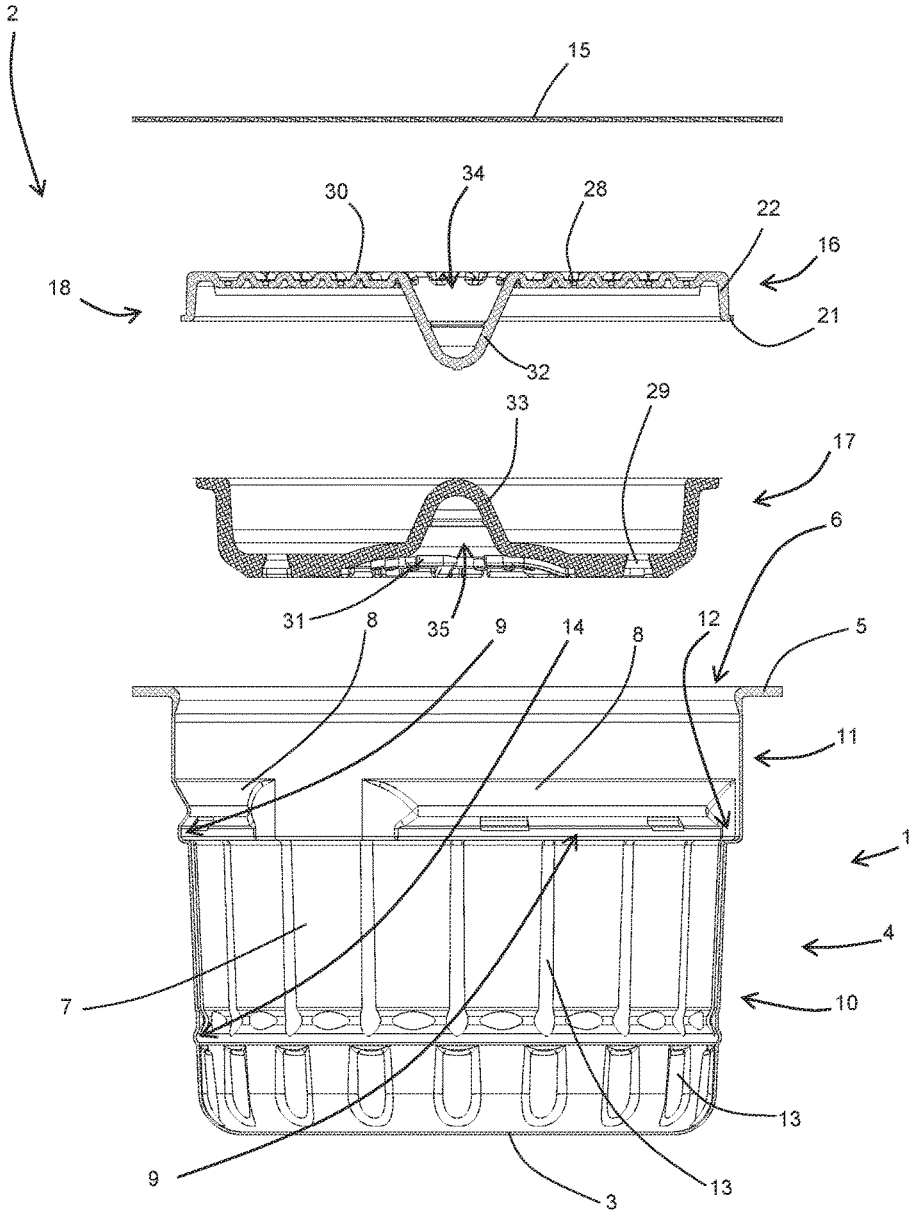
FIG. 4 is a front view of the capsule of FIG. 3.

Regarding the different capsules 2 that can be made using the containment body 1 according to this invention, several examples are shown in the accompanying figures, in which FIGS. 3 to 6 and 13 and 14 respectively show two different capsules 2 that can be made using the containment body 1 of FIG. 1 even using the same filtering elements and lid. Similarly FIGS. 9 to 12 and 15 and 16 respectively show two different capsules 2 that can be made using the containment body of 1 FIG. 7 again in this case using the same filtering elements and lid. However, of said capsules 2, only those of FIGS. 3 to 6 and 9 to 12 are in themselves innovative, since they use the distinctive features of the containment body 1 according to this invention. The capsules of FIGS. 13 to 16, although using the same containment body 1 as those of FIGS. 3 to 6 and 9 to 12, have a structure corresponding to that of traditional capsules 2. In fact, as already indicated, a further innovative aspect of this invention is the fact that, thanks to the containment body 1 described above, it has been possible to define a method that, using the same components, allows capsules 2 to be made which contain different quantities of powdered food substance. In the embodiments illustrated, that comprises making a capsule 2 similar to the prior art ones when using a larger quantity of powdered food substance, and instead making the capsule 2 according to this invention when using a smaller quantity of powdered food substance.

In general, a capsule 2 made using the containment body 1 according to this invention also comprises a lid 15 fixed to the upper edge 5 that closes the top of the inner space 7, a powdered food substance contained in the inner space 7 of the containment body 1, and at least an upper filtering element 16 located between the lid 15 and the powdered food substance. Preferably, it may also be provided with a lower filtering element 17, as in the cases illustrated in the accompanying figures, in particular if the beverage must come out of the capsule 2 through the bottom wall 3.

The upper filtering element 16 comprises at least an annular peripheral edge 18 associated with the lateral wall 4, and divides the inner space 7 into a main chamber 19 delimited between the upper filtering element 16 and the bottom wall 3, and into a secondary chamber 20 delimited between the upper filtering element 16 and the lid 15. As indicated above, the powdered food substance is therefore contained in the main chamber 19.

According to the innovative aspect of this invention, the annular peripheral edge 18 of the upper filtering element 16 is coupled to the undercut seat 9 and the one or more retaining elements 8 limit the maximum movement of the upper filtering element 16 towards the lid 15 interacting at least with the annular peripheral edge 18. Advantageously, insertion of the annular peripheral edge 18 of the upper filtering element 16 in the undercut seat 9 is performed in a snap-in fashion. In other words, the upper filtering element 16 is hooked in a snap-in fashion to the one or more retaining elements 8.

In the embodiments illustrated, the annular peripheral edge 18 is advantageously coupled to the retaining elements 8 and/or to the undercut seat 9 with interference so as to increase the liquid seal between the containment body 1 and the upper filtering element 16.

According to a first embodiment of this invention, the annular peripheral edge 18 comprises one or more radial teeth 21 extending in a plane substantially perpendicular to the central axis and which are inserted in the undercut seat 9. The capsule 2 in FIGS. 3 to 6 shows that embodiment where the annular peripheral edge 18 comprises a single radial tooth 21 forming a ring around the central axis (notice that in the accompanying figures the lower filtering element 17 also has a similar structure). In more detail, the annular peripheral edge 18 comprises an axial portion 22 extending away from a plane perpendicular to the central axis, to which the radial tooth 21 is fixed.

According to a second embodiment of this invention illustrated in FIGS. 9 to 12, the annular peripheral edge 18 comprises an outer retaining portion 23 which, in a cross-section plane passing through the central axis, comprises an inner first stretch 24 (similar to the axial portion 22 described above) extending away from a plane perpendicular to the central axis, and an outer second stretch 25 which is bent over the first stretch 24 and which together with the first stretch 24 forms a V shape. At least at the second stretch 25 the retaining portion 23 is elastically deformable in such a way as to allow the second stretch 25 to be drawn near to the first stretch 24. Thanks to that shape, the retaining portion 23 is coupled to the lateral wall 4 at the undercut seat 9 in such a way that the retaining portion 23 is elastically deformed and the second stretch 25 is drawn near to the first stretch 24. In fact, in this way, the elastic behaviour of the retaining portion 23 presses the second stretch 25 against the lateral wall 4 increasing the liquid seal between the containment body 1 and the upper filtering element 16. The retaining portion 23 is also advantageously inserted in the undercut seat 9 at least at its own second stretch 25.

As shown in the accompanying figures, and as indicated above, depending on the structure of the upper filtering element 16 used, the axial position of the one or more retaining elements 8 and of the undercut seat 9 of the containment body 1 changes.

Finally, in the embodiments of the accompanying figures, the upper filtering element 16 and the lower filtering element 17 both comprise an inner zone 26, 27 extending at least mainly in a plane perpendicular to the central axis, equipped with through holes 28, 29 and projections 30, 31 (on the opposite side to that in contact with the powdered food substance) and at the centre of which there is a projecting element 32, 33 which forms a recess 34, 35 on the side respectively facing the lid 15 or the bottom wall 3. The recesses 34, 35 are designed to allow the insertion respectively through the lid 15 and the bottom wall 3, of suitable piercing spikes during use of the capsule 2. However, it should be noticed that the recess 34 of the upper filtering element 16 is generally only really useful if the capsule 2 contains the second quantity of powdered food substance. Advantageously, both the upper filtering element 16 and the lower filtering element 17 are constituted of a moulded plastic material. In the case of the upper filtering element 16 the annular peripheral edge 18 extends cantilever-style from the inner zone 26.

Regarding the final innovative aspect of this invention, it consists of the method for making capsules 2 for making beverages containing either a smaller quantity or a larger quantity of the powdered food substance, using a single type of containment body 1 (and advantageously a single type of upper filtering element 16).

That method comprises first the steps of taking a containment body 1 made according to this invention and an upper filtering element 16 comprising at least an annular peripheral edge 18 couplable to the undercut seat 9 of the containment body 1 in such a way that the one or more retaining elements 8 limit the maximum movement of the upper filtering element 16 towards the lid 15.

In this way, as already explained, when the annular peripheral edge 18 is coupled to the undercut seat 9, the upper filtering element 16 divides the inner space 7 into a main chamber 19 delimited between the upper filtering element 16 and the bottom wall 3, and into a secondary chamber 20 delimited between the upper filtering element 16 and the access opening 6. At that point the method comprises two alternatives, depending on the type of capsule 2 to be made:

- either taking a first quantity of powdered food substance which occupies a volume not greater than that of the main chamber 19,
- or, respectively, taking a second quantity of powdered food substance which occupies a volume greater than that of the main chamber 19 and not greater than the sum of the volumes of the main chamber 19 and the secondary chamber 20.

As regards the volume occupied by the powdered food substance, depending on requirements it may be either that occupied by it in an unpressed condition or that occupied by it in a pressed condition. In the latter case, the method will advantageously also comprise a step of pressing the powdered food substance inserted in the containment body 1 that is performed either simultaneously with or after the step of inserting the powdered food substance.

The method then comprises inserting in the inner space 7 the first quantity or respectively the second quantity of powdered food substance, through the access opening 6, and then inserting in the inner space 7, again through the access opening 6, the upper filtering element 16, which will therefore be positioned above the powdered food substance, with the annular peripheral edge 18 facing the lateral wall 4. In more detail, when the quantity of powdered food substance inserted in the capsule 2 is equal to the first quantity, the upper filtering element 16 is inserted in the containment body 1 in such a way that the annular peripheral edge 18 is coupled to the undercut seat 9. In contrast, when the quantity of powdered food substance inserted in the capsule 2 is equal to the second quantity, the upper filtering element 16 is positioned in the inner space 7 close to the access opening 6.

Finally, the method comprises the step of closing the access opening 6 by fixing a lid 15 to the upper edge 5.

In the preferred embodiment of the method according to this invention, the same type of filtering element is used both for making capsules 2 with the first quantity of powdered food substance and for making capsules 2 with the second quantity of powdered food substance.

In particular, as already indicated, the upper filtering element 16 that is used may advantageously comprise an annular peripheral edge 18 that comprises one or more radial teeth 21 that extend in a plane substantially perpendicular to the central axis and that are couplable to the undercut seat 9, or an annular peripheral edge 18 that comprises an outer retaining portion 23 which, in a cross-section plane passing through the central axis, comprises an inner first stretch 24 and an outer second stretch 25 which is bent over the first stretch 24 and which together with the first stretch 24 forms a V shape. Moreover, in the latter case, at least at the second stretch 25 the retaining portion 23 is elastically deformable in such a way as to allow the second stretch 25 to be drawn near to the first stretch 24. In fact, in this way, if the capsule 2 contains the first quantity of powdered food substance, after the step of inserting the upper filtering element 16 in the inner space 7, the retaining portion 23 can be coupled to the lateral wall 4 at the undercut seat 9 in such a way that it elastically deformed with the second stretch 25 near to the first stretch 24. Preferably, however, even if the capsule 2 contains the second quantity of powdered food substance, after the step of inserting the upper filtering element 16 in the inner space 7, the retaining portion 23 is coupled to the lateral wall 4 with the retaining portion 23 elastically deformed and with the second stretch 25 near to the first stretch 24.

In addition, when the quantity of powdered food substance inserted in the capsule 2 is equal to the first quantity, the upper filtering element 16 is preferably inserted in the containment body 1 in such a way that the annular peripheral edge 18 is hooked in a snap-in fashion to the one or more retaining elements 8.

This invention brings important advantages.

In fact, thanks to this invention it has been possible to standardise the production of capsules 2 by always using the same components and varying exclusively the quantity of powdered food substance. Consequently, a containment body and a method have been defined which allow the production of a single system that can be used to make both "long" and "short" beverages of optimum quality.

Finally, it should be noticed that this invention is relatively easy to produce and that even the cost linked to implementing the invention is not very high. The invention described above may be modified and adapted in several ways without thereby departing from the scope of the inventive concept.

All details of the invention may be substituted with other technically equivalent elements and the materials used, as well as the shapes and dimensions of the various components, may vary according to requirements.

The invention claimed is:

1. A containment body for making a capsule for making beverages, comprising:

a bottom wall (3);

a lateral wall (4) connected to the bottom wall (3) at a peripheral portion of the bottom wall; and an upper edge (5) connected to the lateral wall (4) on a side opposite to the bottom wall (3) and delimiting an access opening (6) for accessing an inner space (7) of the containment body (1), the inner space (7) being delimited at the bottom by the bottom wall (3) and laterally by the lateral wall (4), in use a powdered food substance for making a beverage and one or more filtering elements being insertable in the inner space (7);

a central axis of the containment body (1) being identifiable between a central point of the bottom wall (3) and a central point of the access opening (6);

characterised in that the lateral wall (4), in a zone of the lateral wall closer to the upper edge (5) than to the bottom wall (3), is provided with one or more retaining elements (8) projecting towards the central axis in a plane perpendicular to the central axis, the one or more retaining elements (8) forming between the one or more retaining elements and the bottom wall (3) an undercut seat (9) relative to the line of extension of the central axis;

wherein the lateral wall (4) comprises, from the bottom wall (3) towards the upper edge (5), a first portion (10) and a second portion (11), the first portion (10) having a frusto-conical shape, and the second portion (11) having a cylindrical shape, the second portion (11) having an internal diameter which is larger than a maximum internal diameter of the first portion (10), and wherein the one or more retaining elements (8) and the undercut seat (9) are all made at the second portion (11).

2. The containment body according to claim 1, characterised in that the lateral wall (4) is provided with a plurality of said retaining elements (8) which are distributed about the central axis in said plane perpendicular to the central axis, and which are spaced relative to one another.

3. The containment body according to claim 1, characterised in that the first portion (10) comprises a plurality of stiffening profiles (13).

4. The containment body according to claim 1, characterised in that at a zone of the lateral wall closer to the bottom wall (3) than to the access opening (6), the lateral wall (4) also comprises a hooking seat (14) formed by a portion of the lateral wall projecting towards the central axis and/or away from the central axis.

5. The containment body according to claim 1, characterised in that it is at least mainly constituted of a thermoformed multi-layer material.

6. A capsule for making beverages, containing a powdered food substance which allows a beverage to be made by passing hot water through the powdered food substance, the capsule (2) comprising a containment body (1) presenting:

a bottom wall (3);

a lateral wall (4) connected to the bottom wall (3) at a peripheral portion of the bottom wall; and an upper edge (5) connected to the lateral wall (4) on a side opposite to the bottom wall (3) and delimiting an access opening (6) for accessing an inner space (7) of the containment body (1), the inner space (7) being delimited at the bottom by the bottom wall (3) and laterally by the lateral wall (4), in use a powdered food substance for making a beverage and one or more filtering elements being insertable in the inner space (7);

a central axis of the containment body (1) being identifiable between a central point of the bottom wall (3) and a central point of the access opening (6);

wherein the lateral wall (4), in a zone of the lateral wall closer to the upper edge (5) than to the bottom wall (3), is provided with one or more retaining elements (8) projecting towards the central axis in a plane perpendicular to the central axis, the one or more retaining elements (8) forming between the one or more retaining elements and the bottom wall (3) an undercut seat (9) relative to the line of extension of the central axis;

wherein the capsule further comprises a lid (15) fixed to the upper edge (5) which closes the top of the inner space (7);

wherein said powdered food substance is contained in the inner space (7) of the containment body (1);

wherein the capsule further comprises at least an upper filtering element (16) comprising at least an annular peripheral edge (18) associated with the lateral wall (4), the upper filtering element (16) dividing the inner space (7) into a main chamber (19) delimited between the upper filtering element (16) and the bottom wall (3), and into a secondary chamber (20) delimited between the upper filtering element (16) and the lid (15), the powdered food substance being contained in the main chamber (19);

wherein the annular peripheral edge (18) is coupled to said undercut seat (9) and wherein the one or more retaining elements (8) limit the maximum movement of the upper filtering element (16) towards the lid (15).

7. The capsule according to claim 6, characterised in that the annular peripheral edge (18) is coupled to the one or more retaining elements (8) and/or to the undercut seat (9) with interference fit.

8. The capsule according to claim 7, characterised in that at a zone of the containment body closer to the bottom wall (3) than to the access opening (6), the lateral wall (4) also comprises a hooking seat (14) formed by a portion of the lateral wall projecting towards the central axis and/or away from the central axis.

9. The capsule according to claim 7, characterised in that the containment body is at least mainly constituted of a thermoformed multi-layer material.

10. The capsule according to claim 6, characterised in that the annular peripheral edge (18) comprises one or more radial teeth (21) extending in a plane perpendicular to the central axis and which are inserted in the undercut seat (9).

11. The capsule according to claim 10, characterised in that at a zone of the containment body closer to the bottom wall (3) than to the access opening (6), the lateral wall (4) also comprises a hooking seat (14) formed by a portion of the lateral wall projecting towards the central axis and/or away from the central axis.

12. The capsule according to claim 10, characterised in that the containment body is at least mainly constituted of a thermoformed multi-layer material.

13. The capsule according to claim 6, characterised in that the annular peripheral edge (18) comprises an outer retaining portion (23) which, in a cross-section plane passing through the central axis, comprises an inner first stretch (24) extending away from a plane perpendicular to the central axis, and an outer second stretch (25) which is bent over the first stretch (24) and which together with the first stretch (24) forms a V shape, at least at the second stretch (25) the retaining portion (23) being elastically deformable in such a way as to allow the second stretch (25) to be drawn near to the first stretch (24), the retaining portion (23) being coupled to the lateral wall (4) at the undercut seat (9) in such a way that the retaining portion (23) is elastically deformed and the second stretch (25) is near to the first stretch (24).

14. The capsule according to claim 13, characterised in that the retaining portion (23) is inserted in the undercut seat (9) at least at the second stretch (25).

15. The capsule according to claim 13, characterised in that at a zone of the containment body closer to the bottom wall (3) than to the access opening (6), the lateral wall (4) also comprises a hooking seat (14) formed by a portion of the lateral wall projecting towards the central axis and/or away from the central axis.

16. The capsule according to claim 6, characterised in that the upper filtering element (16) is hooked in a snap-in fashion to the one or more retaining elements (8).

17. The capsule according to claim 6, characterised in that the lateral wall (4) is provided with a plurality of said retaining elements (8) which are distributed about the central axis in said plane perpendicular to the central axis, and which are spaced relative to one another.

18. The capsule according to claim 6, characterised in that the lateral wall (4) comprises, from the bottom wall (3) towards the upper edge (5), a first portion (10) and a second portion (11), the first portion (10) at least mainly having a frustoconical shape, and the second portion (11) having a cylindrical shape, the second portion (11) having an internal diameter which is larger than a maximum internal diameter of the first portion (10), and in that the one or more retaining elements (8) and the undercut seat (9) are all made at the second portion (11).

19. The capsule according to claim 18, characterised in that the first portion (10) comprises a plurality of stiffening profiles (13).

20. The capsule according to claim 6, characterised in that at a zone of the containment body closer to the bottom wall (3) than to the access opening (6), the lateral wall (4) also comprises a hooking seat (14) formed by a portion of the lateral wall projecting towards the central axis and/or away from the central axis.

21. The capsule according to claim 6, characterised in that the containment body is at least mainly constituted of a thermoformed multi-layer material.

22. A method for making capsules for making beverages, containing a first quantity or a second quantity larger of the first quantity, of at least one powdered food substance which allows a beverage to be made by passing hot water through the powdered food substance, using a single type of containment body (1), comprising the steps of:

taking a containment body (1) presenting:

a bottom wall (3);

a lateral wall (4) connected to the bottom wall (3) at a peripheral portion of the bottom wall; and an upper edge (5) connected to the lateral wall (4) on a side opposite to the bottom wall (3) and delimiting an access opening (6) for accessing an inner space (7) of the containment body (1), the inner space (7) being delimited at the bottom by the bottom wall (3) and laterally by the lateral wall (4), in use a powdered food substance for making a beverage and one or more filtering elements being insertable in the inner space (7);

a central axis of the containment body (1) being identifiable between a central point of the bottom wall (3) and a central point of the access opening (6);

wherein the lateral wall (4), in a zone of the lateral wall closer to the upper edge (5) than to the bottom wall (3), is provided with one or more retaining elements (8) projecting towards the central axis in a plane perpendicular to the central axis, the one or more retaining elements (8) forming between the one or more retaining elements and the bottom wall (3) an undercut seat (9) relative to the line of extension of the central axis;

taking at least an upper filtering element (16) comprising at least an annular peripheral edge (18) couplable to the undercut seat (9) in such a way that the one or more retaining elements (8) limit the maximum movement of the upper filtering element (16) towards the lid (15), when the annular peripheral edge (18) is coupled to the undercut seat (9) the upper filtering element (16) dividing the inner space (7) into a main chamber (19) delimited between the upper filtering element (16) and the bottom wall (3), and into a secondary chamber (20) delimited between the upper filtering element (16) and the access opening (6);

taking a first quantity of powdered food substance which occupies a volume not greater than that of the main chamber (19), or respectively a second quantity of powdered food substance which occupies a volume greater than that of the main chamber (19) and not greater than the sum of the volumes of the main chamber (19) and the secondary chamber (20);

inserting in the inner space (7) the first quantity or respectively the second quantity of powdered food substance, through the access opening (6);

then inserting in the inner space (7), through the access opening (6), the upper filtering element (16) above the powdered food substance, positioning the annular peripheral edge (18) so that the annular peripheral edge is facing the lateral wall (4); and closing the access opening (6) by fixing a lid (15) to the upper edge (5);

when the quantity of powdered food substance inserted in the capsule (2) is equal to the first quantity, the upper filtering element (16) being inserted in the containment body (1) in such a way that the annular peripheral edge (18) is coupled to the undercut seat (9); whilst when the quantity of powdered food substance inserted in the capsule (2) is equal to the second quantity, the upper filtering element (16) being positioned close to the access opening (6).

23. The method according to claim 22, characterised in that the same type of filtering element is taken both for making capsules (2) with the first quantity of powdered food substance and for making capsules (2) with the second quantity of powdered food substance.

24. The method according to claim 23, characterised in that it comprises the step of taking an upper filtering element (16) whose annular peripheral edge (18) comprises one or more radial teeth (21) extending in a plane perpendicular to the central axis and which are couplable to the undercut seat (9).

25. The method according to claim 23, characterised in that it comprises the step of taking an upper filtering element (16) whose annular peripheral edge (18) comprises an outer retaining portion (23) which, in a cross-section plane passing through the central axis, comprises an inner first stretch (24) and an outer second stretch (25) which is bent over the first stretch (24) and which together with the first stretch (24) forms a V shape, at least at the second stretch (25) the retaining portion (23) being elastically deformable in such a way as to allow the second stretch (25) to be drawn near to the first stretch (24), at least in the case in which the capsule (2) contains the first quantity of powdered food substance, after the step of inserting the upper filtering element (16) in the inner space (7), the retaining portion (23) being coupled to the lateral wall (4) at the undercut seat (9) in such a way that the retaining portion (23) is elastically deformed and the second stretch (25) is near to the first stretch (24).

26. The method according to claim 22, characterised in that it comprises the step of taking an upper filtering element (16) whose annular peripheral edge (18) comprises one or more radial teeth (21) extending in a plane perpendicular to the central axis and which are couplable to the undercut seat (9).

27. The method according to claim 22, characterised in that it comprises the step of taking an upper filtering element (16) whose annular peripheral edge (18) comprises an outer retaining portion (23) which, in a cross-section plane passing through the central axis, comprises an inner first stretch (24) and an outer second stretch (25) which is bent over the first stretch (24) and which together with the first stretch (24) forms a V shape, at least at the second stretch (25) the retaining portion (23) being elastically deformable in such a way as to allow the second stretch (25) to be drawn near to the first stretch (24), at least in the case in which the capsule (2) contains the first quantity of powdered food substance, after the step of inserting the upper filtering element (16) in the inner space (7), the retaining portion (23) being coupled to the lateral wall (4) at the undercut seat (9) in such a way that the retaining portion (23) is elastically deformed and the second stretch (25) is near to the first stretch (24).

28. The method according to claim 27, characterised in that even in the case in which the capsule (2) contains the second quantity of powdered food substance, after the step of inserting the upper filtering element (16) in the inner space (7), the retaining portion (23) is coupled to the lateral wall (4) with the retaining portion (23) elastically deformed with the second stretch (25) near to the first stretch (24).

29. The method according to claim 28, characterised in that when the quantity of powdered food substance inserted in the capsule (2) is equal to the first quantity, the upper filtering element (16) is inserted in the containment body (1) in such a way that the annular peripheral edge (18) is hooked in a snap-in fashion to the one or more retaining elements (8).

30. The method according to claim 22, wherein the step of taking a containment body comprises taking a containment body in which the lateral wall (4) is provided with a plurality of said retaining elements (8) which are distributed about the central axis in said plane perpendicular to the central axis, and which are spaced relative to one another.

31. The method according to claim 22, wherein the step of taking a containment body comprises taking a containment body in which the lateral wall (4) comprises, from the bottom wall (3) towards the upper edge (5), a first portion (10) and a second portion (11), the first portion (10) at least mainly having a frustoconical shape, and the second portion (11) having a cylindrical shape, the second portion (11) having an internal diameter which is larger than a maximum internal diameter of the first portion (10), and in which the one or more retaining elements (8) and the undercut seat (9) are all made at the second portion (11).

32. The method according to claim 31, wherein the step of taking a containment body comprises taking a containment body in which the first portion (10) comprises a plurality of stiffening profiles (13).

33. The method according to claim 22, wherein the step of taking a containment body comprises taking a containment body in which at a zone of the containment body closer to the bottom wall (3) than to the access opening (6), the lateral wall (4) also comprises a hooking seat (14) formed by a portion of the lateral wall projecting towards the central axis and/or away from the central axis.

34. The method according to claim 22, wherein the step of taking a containment body comprises taking a containment body which is at least mainly constituted of a thermoformed multi-layer material.

* * * * *